US010524557B1

(12) United States Patent
McDaniel et al.

(10) Patent No.: US 10,524,557 B1
(45) Date of Patent: Jan. 7, 2020

(54) LOCK FOR COSMETIC HOLDER

(71) Applicants: Jason McDaniel, Morriston, FL (US); Amanda Aponte, Morriston, FL (US)

(72) Inventors: Jason McDaniel, Morriston, FL (US); Amanda Aponte, Morriston, FL (US)

( * ) Notice: Subject to any disclaimer, the term of this patent is extended or adjusted under 35 U.S.C. 154(b) by 0 days.

(21) Appl. No.: 16/106,531

(22) Filed: Aug. 21, 2018

(51) Int. Cl.
*A45D 40/12* (2006.01)
*A45D 40/06* (2006.01)
*A45D 40/00* (2006.01)

(52) U.S. Cl.
CPC ..... *A45D 40/12* (2013.01); *A45D 40/06* (2013.01); *A45D 2040/0006* (2013.01)

(58) Field of Classification Search
CPC ..... A45D 40/12; A45D 40/06; A45D 2040/0006; A45D 40/065; A45D 40/18; A45D 2040/00; A45D 2034/002; A45D 2034/204; A45D 2034/0012; A45D 2040/0025; A45D 2040/0062; A45D 2040/205
See application file for complete search history.

(56) References Cited

U.S. PATENT DOCUMENTS 2,171,112 A * 8/1939 Hoffman ..... A45D 40/12 401/61
2,485,105 A * 10/1949 McKnight ..... A45D 40/04 401/61
5,240,337 A 8/1993 Gruner
5,871,295 A 2/1999 Bouix
5,984,552 A 11/1999 Ackermann et al.
6,966,716 B2 * 11/2005 Pink ..... A45D 34/045 401/126

* cited by examiner

*Primary Examiner* — David J Walczak
(74) *Attorney, Agent, or Firm* — Sanchelima & Associates, P.A.; Christian Sanchelima; Jesus Sanchelima

(57) ABSTRACT

A lock unit for a cosmetic holder. The lock unit has a lock placed around a base of the cosmetic holder. The base of the cosmetic holder is normally rotated to dispense the required amount of cosmetic. The lock is used to prevent the base of the cosmetic holder from spindling and dispensing cosmetic, when the cosmetic holder is not in use. The lock is removed to release locking around the base of the cosmetic holder. The locking around the base of the cosmetic holder is released to allow a user to spin the base of the cosmetic holder to dispense more cosmetic when required.

8 Claims, 3 Drawing Sheets

LOCK FOR COSMETIC HOLDER

BACKGROUND OF THE INVENTION

1. Field of the Invention

The present disclosure relates to a lock for cosmetic holder. More particularly, the present disclosure relates to a lock used in cosmetic holder for example, lipsticks, lip balms and the like, to prevent wastage of cosmetic by accidental spindling of cosmetic holder when it is not in use.

2. Description of the Related Art

Cosmetic holders such as lip sticks, lip balms, eye kohl and so on, are already known in the art. Such cosmetic holders are usually stick type. One need to turn the bottom of the stick or need to press the stick to eject the cosmetics out for the user to use. After consumption, user closes the stick and place in the pocket or cosmetic container. When placed in the pocket, the bottom of the stick may accidentally spindle and may cause cosmetics to come out more than required. Thus more cosmetics may get wasted.

Applicant believes that a related reference corresponds to United States patent application U.S. Pat. No. 5,240,337A filed by ROCMA CONCEPTS GMBH BERATUNG for a cosmetic stick holder. The reference discloses a cosmetic stick holder, such as a lip stick holder, features a cosmetic stick mechanism having a piston supporting the cosmetic stick. The cosmetic stick is extended or retracted into the cosmetic stick mechanism upon rotation of a screwing sleeve forming part of the cosmetic stick mechanism. The screwing sleeve is exchangeably held with its foot part in an outer cap member by a releasable lock having two locking parts provided on the outer cap member and the foot part so as to prevent axial movement of the foot part and cap member and to provide for release of the two upon rotation of the foot part with respect to the cap member when the piston is fully retracted.

Applicant believes that another related reference corresponds to United States patent application U.S. Pat. No. 5,871,295A filed by E-L MANAGEMENT CORP for a push-up locking mass lipstick cup. The reference discloses a holder cup for a stick-type product that prevents the release of the stick-type product from the holder cup. The holder cup comprises a hollow housing which is closed at one end and configured to receive a stick-type product at the other end, said hollow housing having an inner wall and an outer wall, the inner wall containing one or more longitudinal grooves, each longitudinal groove having a first end which is tapered towards the center of the holder cup and a second end which passes through the closed end of the housing to form an aperture. A push-up is then provided, which comprises a base and one or more rods projecting axially outwardly from the base, said rods being positioned to align and dimensioned to fit within the longitudinal groove, and said rods having a length greater than that of the longitudinal groove.

Applicant believes that another related reference corresponds to United States patent application U.S. Pat. No. 5,984,552A filed by RISDON CORP for locking lipstick container. The reference discloses a "Lock" for this impel/repel lipstick container comprises a downward extension at the lower end of the slot in the inner body. The extension is adapted to receive the pomade cup lug and is partly defined by a margin portion facing in opposition to the direction in which the lug is moved when the cam is turned to raise the cup. When a user attempts to propel the pomade upward by turning the cam relative to the inner body, the cam track merely forces the lug against the margin portion of the extension. To unlock, the salesperson applies a tool upward into the base of the lipstick container to raise the pomade cup so that the lug moves upward out of the extension.

Other documents describing the closest subject matter provide for a number of more or less complicated features that fail to solve the problem in an efficient and economical way. None of these patents suggest the novel features of the present invention.

SUMMARY OF THE INVENTION

It is an object of the present invention to provide a lock that is used in cosmetic holder for example, lipsticks, lip balms and the like, to prevent wastage of cosmetic by accidental spindling of cosmetic holder when it is not in use.

It is yet another object of the present invention to provide a lock unit for cosmetic holder. The lock unit has a lock placed around a base of a cosmetic holder. The base of cosmetic holder is normally rotated to dispense required amount of cosmetic. The lock is used to prevent base of cosmetic holder from spindling and dispensing cosmetic, when cosmetic holder is not in use. The lock is adjustable/removed to release locking around base of cosmetic holder, which allows user to spindle base of cosmetic holder to dispense more cosmetic when required.

It is still another object of the present invention to provide lock unit for cosmetic holder that is made of flexible material, such as rubber. The flexibility of lock allows it to adjust or remove along the cosmetic holder, to perform locking and unlocking operations.

Further objects of the invention will be brought out in the following part of the specification, wherein detailed description is for the purpose of fully disclosing the invention without placing any limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
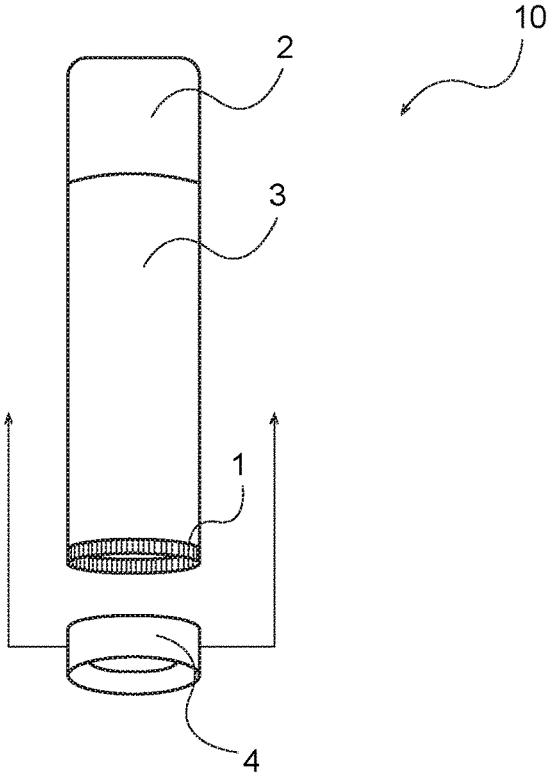
FIG. 1 represents an isometric view of the present invention before installing a lock 4 over a base 1 of cosmetic holder 10.

Referring now to the drawings, FIGS. 1-5, where the present invention is generally referred to with numeral 4, it can be observed that a lock 4 is installed on cosmetic holder 10 to prevent dispensing cosmetic from cosmetic holder 10, when cosmetic holder 10 is not in use.

FIG. 1 represents an isometric view of the present invention before installing a lock 4 over a base 1 of cosmetic holder 10. The cosmetic holder 10 in closed state shows base 1, outer unit 3 and cap 2. The bottom of the outer unit 3 has base 1 rotatabily attached to it. The lock 4 is used to hold base 1 of cosmetic holder 10 and prevent base 1 of cosmetic holder 10 from spindling and dispensing cosmetic, when cosmetic holder 10 is not in use.

Figure 2:
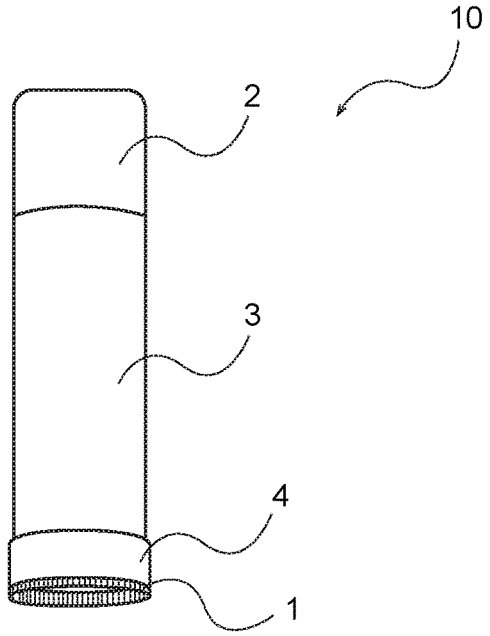
FIG. 2 demonstrates an isometric view of the present invention after installing lock 4 over cosmetic holder 10.

FIG. 2 demonstrates an isometric view of the present invention after installing lock 4 over cosmetic holder 10. Sometimes when cosmetic holder 10 is not used, user may keep cosmetic holder 10 inside purse or shirt/pant pockets. This may accidently rotate base 1 of cosmetic holder 10 and dispense cosmetic in cosmetic holder 10. Lock 4 prevents base 1 of cosmetic holder 10 from spindling and dispensing cosmetic, when cosmetic holder 10 is not in use.

Figure 3:
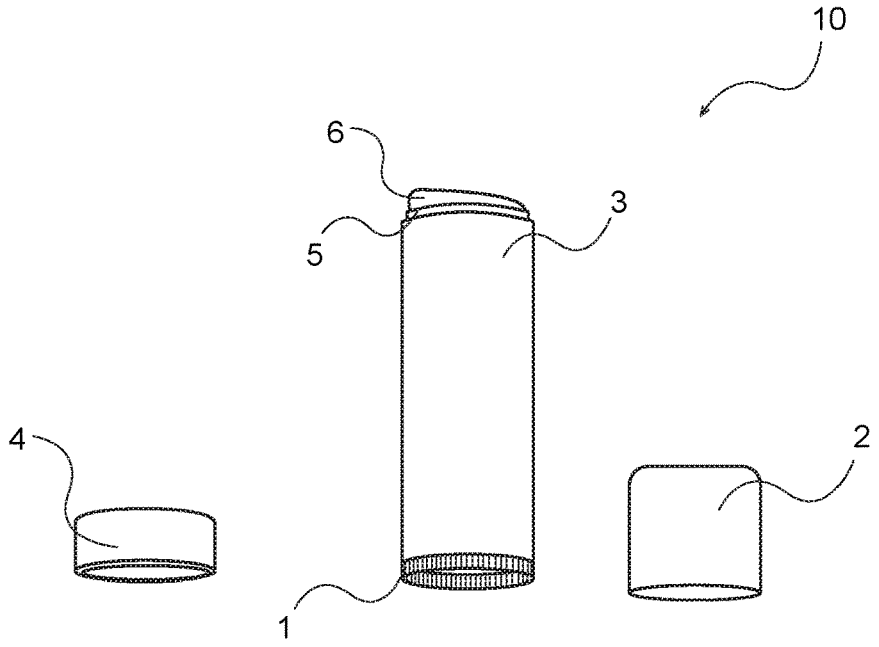
FIG. 3 demonstrates an isometric view of the present invention after removing lock 4 from cosmetic holder 10, to release lock 4 on base 1 of cosmetic holder 10.
Figure 4:
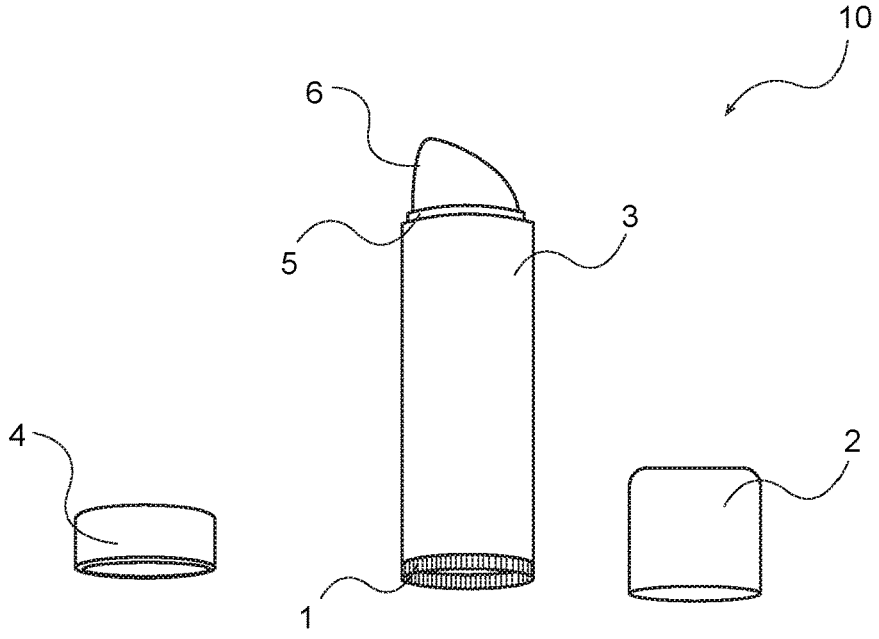
FIG. 4 demonstrates an isometric view of the present invention after removing lock 4 as in FIG. 3, base 1 of cosmetic holder 10 is moved to dispense required cosmetic 6.

FIG. 3 demonstrates an isometric view of the present invention, after removing lock 4 from base 1 of cosmetic holder 10, to release lock 4 on base 1 of cosmetic holder 10. Cosmetic 6 is held inside an inner unit 5. As shown in FIG. 3, cosmetic 6 in inner unit 5 is not sufficient for user to use. At this stage, user can remove lock 4 from base 1 to release lock on base 1. Once lock 4 is removed, base 1 is free to rotate and the rotational force or spindling of base 1 moves/pushes inner unit 5 with cosmetic 6 upward. User can rotate base 1, then sufficient cosmetic 6 is dispensed from inner unit 5, as shown in FIG. 4.

It should be noted that, the cosmetic holder 10, can be any type and the mechanism used to dispense cosmetic can be any type without limitation. The present invention is applicable to all types of cosmetic holders or applicators that dispenses cosmetic to user from any type of holders or containers or tubes and the like. Cosmetic holders and applicators are not limited to lip sticks, lip balms or eye kohl. The cosmetic dispensing mechanism is not limited to rotational to linear type dispensers, press type dispenser and the like.

Figure 5:
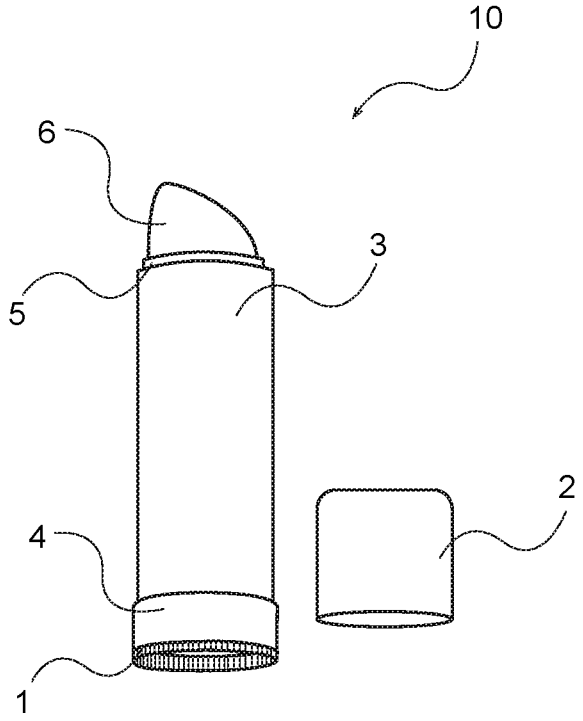
FIG. 5 demonstrates an isometric view of the present invention after removing base 1 as in FIG. 4, lock 4 is again placed on base 1 of cosmetic holder 10.

Once sufficient cosmetic 6 (sufficient height of cosmetic 6) is dispensed from inner unit 5, as shown in FIG. 5, the user can once again place lock 4 on base 1 of cosmetic holder 10. This prevents accidental dispense of cosmetic 6 from inner unit 5. FIGS. 1-2 show cosmetic holder closed using cap 2 and FIGS. 3-5 show cosmetic holder open by removing cap 2. In one embodiment of the invention, the lock 4 is comprised in a lock unit.

Usually lock takes shape of the unit that is operated to release cosmetic. This prevent cosmetic from being wasted. Lock is made of flexible material such as rubber. The flexibility of lock allows it to adjust or move along the cosmetic holder, to perform locking and unlocking operations. Further, the lock may comprise at least one impression and/or at least one projection on a whole portion or partial portion of lock surface to facilitate easy installation and adjustment/removal of lock over cosmetic holder.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A lock unit, comprising:

a lock placed around a base of a cosmetic holder, said lock being flexible, said base having a base circumference and ridges extending along said base circumference, said lock having a lock thickness and a lock circumference, said cosmetic holder having a cosmetic holder circumference, said cosmetic holder including a cap, an inner unit and an outer unit, said inner unit housed therein said outer unit, said cap being removable from said outer unit, said cap and said outer unit being flush when said cap is mounted to said outer unit, said cap is secured atop of said outer unit, said base being at a bottom end of said cosmetic holder underneath said outer unit, said lock circumference being greater than said cosmetic holder circumference; and wherein said lock engages said base to prevent said base of said cosmetic holder from rotating and dispensing a cosmetic, said lock fitting snuggly around said outer unit and flush around said base of said cosmetic holder, said lock substantially covering half of said base and a predetermined length of said outer unit above said base when said lock engages said base, said lock further leaving said ridges below said lock exposed when said lock engages said base, said lock thickness protruding outwardly when said lock engages said base.

2. The lock unit of claim 1, wherein said lock is removable to release locking around said base of said cosmetic holder.

3. The lock unit of claim 2, wherein locking around said base of said cosmetic holder is removed to allow spindling of said base of said cosmetic holder to dispense more of said cosmetic when required.

4. The lock unit of claim 1, wherein said lock is made of a rubber material.

5. The lock unit of claim 1, wherein said lock takes the shape of said base of said cosmetic holder.

6. The lock unit of claim 1, wherein said lock comprises at least one impression or at least one projection on a surface of said lock to facilitate easy installation and removal of said lock over said cosmetic holder.

7. The lock unit of claim 1, wherein said lock is an elastic cylindrical band.

8. The lock unit of claim 1, wherein said base is a rotary dial.

* * * * *